US006457255B1

(12) United States Patent
Carlyle

(10) Patent No.: US 6,457,255 B1
(45) Date of Patent: Oct. 1, 2002

(54) RING TO RING GAS PROCESSOR/DRYER

(76) Inventor: Allan M. Carlyle, 5587 Heather Street, Vancouver, British Columbia (CA), V6Z 3M3

( * ) Notice: Subject to any disclaimer, the term of this patent is extended or adjusted under 35 U.S.C. 154(b) by 0 days.

(21) Appl. No.: 09/597,352

(22) Filed: Jun. 19, 2000

(51) Int. Cl.[7] ..... F26B 9/00

(52) U.S. Cl. ..... 34/164; 34/166; 34/168; 34/169; 34/171; 34/178; 34/588

(58) Field of Search ..... 34/164, 166, 168, 34/169, 171, 178, 174, 175, 588, 233

(56) References Cited

U.S. PATENT DOCUMENTS

| | | | | |
|---|---|---|---|---|
| 3,343,812 A | * | 9/1967 | Moulton | 34/164 |
| 3,667,135 A | | 6/1972 | Rowell | |
| 3,742,614 A | | 7/1973 | Bettermann et al. | |
| 4,237,622 A | | 12/1980 | Francis | |
| 4,548,623 A | | 10/1985 | Naske | |
| 4,785,554 A | * | 11/1988 | Hederer et al. | 34/178 |
| 4,970,806 A | | 11/1990 | Hederer et al. | |
| 5,467,535 A | * | 11/1995 | Lentz | 34/171 |
| 5,483,752 A | | 1/1996 | Kreft et al. | |
| 5,508,243 A | | 4/1996 | Mitzkat et al. | |
| 5,592,748 A | | 1/1997 | Mitzlat et al. | |
| 5,816,386 A | | 10/1998 | Carlyle | |
| 6,035,543 A | | 3/2000 | Carlyle | |

* cited by examiner

*Primary Examiner*—Jiping Lu
(74) *Attorney, Agent, or Firm*—Kolisch Hartwell Dickinson McCormack & Heuser

(57) ABSTRACT

Conditioning apparatus for handling particulate material comprises a central frame and a plurality of spaced, annular troughs mounted to the central frame to support the particulate material. The troughs are arranged in a stacked configuration having successive pairs of upper and lower troughs with an uppermost trough for receiving the particulate material and a lowermost trough for discharging particulate material. Hydraulic cylinders or other suitable means are used to impart vibratory movement to the plurality of troughs to fluidize and advance the particulate material in a first direction on each of the plurality of troughs. A passage is formed through each trough for particulate material to fall from the upper trough of a pair to the lower trough. The passage of the upper trough is non-aligned in a vertical plane with the passage of the lower trough such that particulate material falling from the upper trough is received on the lower trough to travel in the first direction over the distance of the lower trough before reaching the passage of the lower trough. A mixing surface is provided in each passage to promote tumbling and mixing of the particulate material which tends to ensure that all surfaces of the particulate material are exposed and available for the conditioning process. The conditioning apparatus finds particular application in drying of particulate material by passing drying gas through the fluidized material, or in filtering or scrubbing of gas by passing the gas through fluidized particulate material.

11 Claims, 3 Drawing Sheets

RING TO RING GAS PROCESSOR/DRYER

FIELD OF THE INVENTION

This invention relates to the field of fluid and solids conditioning, and, more particularly to apparatus for handling and conditioning of particulate and gaseous material.

BACKGROUND OF THE INVENTION

Materials handling of fluids and solids often involves conditioning steps. Such steps generally involve removing undesirable elements from a material stream by mechanical or chemical means. For example, drying involves removing excess fluid from solids and filtering involves removing unwanted material from a liquid or gas. Often particulate material is used to enhance the operation of the chemical or mechanical process.

One form of conditioning apparatus that is particularly useful is fluidizing apparatus that relies on vibration to fluidize particulate material. Once fluidized, the particulate material can be more easily processed by passing a gas, such as a drying gas, through the material and simultaneously conveyed to a new location. Alternatively, the fluidized particulate material may be used as a filter for treating the gas passing therethrough.

Fluidizing apparatus in the form of vibratory conveyors with gas drying are commonly used for simultaneously transporting and drying particulate material. Particulate materials handled in this manner vary widely and include, but are not limited to, wood fibers and wafers for panel boards, hog fuel for power boilers, dehydrated food stuffs and municipal waste and mill sludges. The degree of fluidization of the material is important to allow drying gas to pass through and circulate freely and continuously around individual particles of material. Such conveyors invariably have troughs or pans which are perforated to allow for free passage of drying gas through the material. In existing perforated trough conveyors , the degree of fluidization is dependent at least partly on the gas flow, and the retention time of the particulate material being conveyed is dependent upon the speed the material moves in the trough together with the length of the trough.

Applicant is the owner or co-owner of the following patents relating to fluidizing apparatus with gas processing:

- U.S. Pat. No. 4,548,623 and Canadian Patent No. 1240918 entitled Perforated Trough Conditioning Device
- U.S. Pat. No. 5,816,386 entitled Fluidizer Conveyor
- U.S. Pat. No. 6,035,543 entitled "Jet Ventilated Conveyor Tray"

Applicant is also the owner of co-pending U.S. patent application Ser. No. 09/119,306 filed Jul. 20, 1998 entitled "Inflatable Cushion Member for Helical Conveyor".

U.S. Pat. No. 4,548,623 to Naske is an example of a helical trough conditioning device for conditioning a fluid stream or a flow of granular solids using a gas. Helical trough conditioning apparatus, in which particulate material follows a continuous helical path about a central cylinder with gas circulating through the floor of the helical trough, is particularly useful for handling and drying of material as such conditioners are compact, rugged and efficient.

Other examples of conditioning apparatus known to applicant includes U.S. Pat. No. 3,742,614 to Bettermann et al., U.S. Pat. No. 4,237,622 to Francis, U.S. Pat. No. 4,970,806 to Hederer et al., U.S. Pat. No. 5,483,752 to Kreft et al., and U.S. Pat. Nos. 5,592,748 and 5,508,243 to Mitzkat et al.

In all types of conditioning apparatus, the goal is consistent and substantially complete treatment of the material undergoing conditioning. In the case of vibratory conditioning apparatus, vibration is required to fluidize and thoroughly mix the particulate material. Effective mixing may be inhibited if the particulate material contains unusually long or wide pieces which are difficult to fluidize. If the goal is drying of the particulate material, incomplete mixing of larger particles will tend to result in only partial drying of the larger pieces as all surfaces will not be equally exposed to the drying gas. If the goal is filtering of a gas by passing through fluidized particulate material, incomplete mixing of the larger particles will result in only partial removal of impurities as all the available reactive surfaces of larger particles may not be exposed to the gas. Therefore, it is desirable to expose the particulate material to additional mechanical action, such as tumbling, that ensures reliable mixing of larger particles.

SUMMARY OF THE INVENTION

To address the problem of proper mixing of particulate material, applicant has developed a new conditioning apparatus that is similar in construction to a helical trough conditioning device and therefore shares the desirable features of being compact, reliable and efficient. Instead of relying on a helical trough, however, the apparatus of the present invention uses a series of discrete, stacked annular troughs that communicate via passages between upper and lower troughs. Particulate material on the upper trough falls due to gravity through the passage to tumble and mix thoroughly on its journey to the lower trough. Mixing surfaces are provided in the passage to enhance the tumbling action. This promotes mixing and tends to ensure that all surfaces of the particulate material are exposed.

Accordingly, the present invention provides conditioning apparatus for handling particulate material comprising:

- a central frame;
- a plurality of spaced, annular troughs mounted to the central frame to support the particulate material, the troughs being arranged in a stacked configuration having successive pairs of upper and lower troughs with an uppermost trough for receiving the particulate material and a lowermost trough for discharging particulate material;
- means for vibrating the plurality of troughs to fluidize and advance the particulate material in a first direction on each of the plurality of troughs;
- a passage formed through each trough for particulate material to fall from the upper trough of a pair to the lower trough, the passage of the upper trough being non-aligned in a vertical plane with the passage of the lower trough such that particulate material falling from the upper trough is received on the lower trough to travel in the first direction over the distance of the lower trough before reaching the passage of the lower trough; and
- a mixing surface in each passage to promote tumbling of the particulate material when falling through the passage.

BRIEF DESCRIPTION OF THE DRAWINGS

Aspects of the present invention are illustrated, merely by way of example, in the accompanying drawings in which.

DESCRIPTION OF THE PREFERRED EMBODIMENTS

Figure 1:
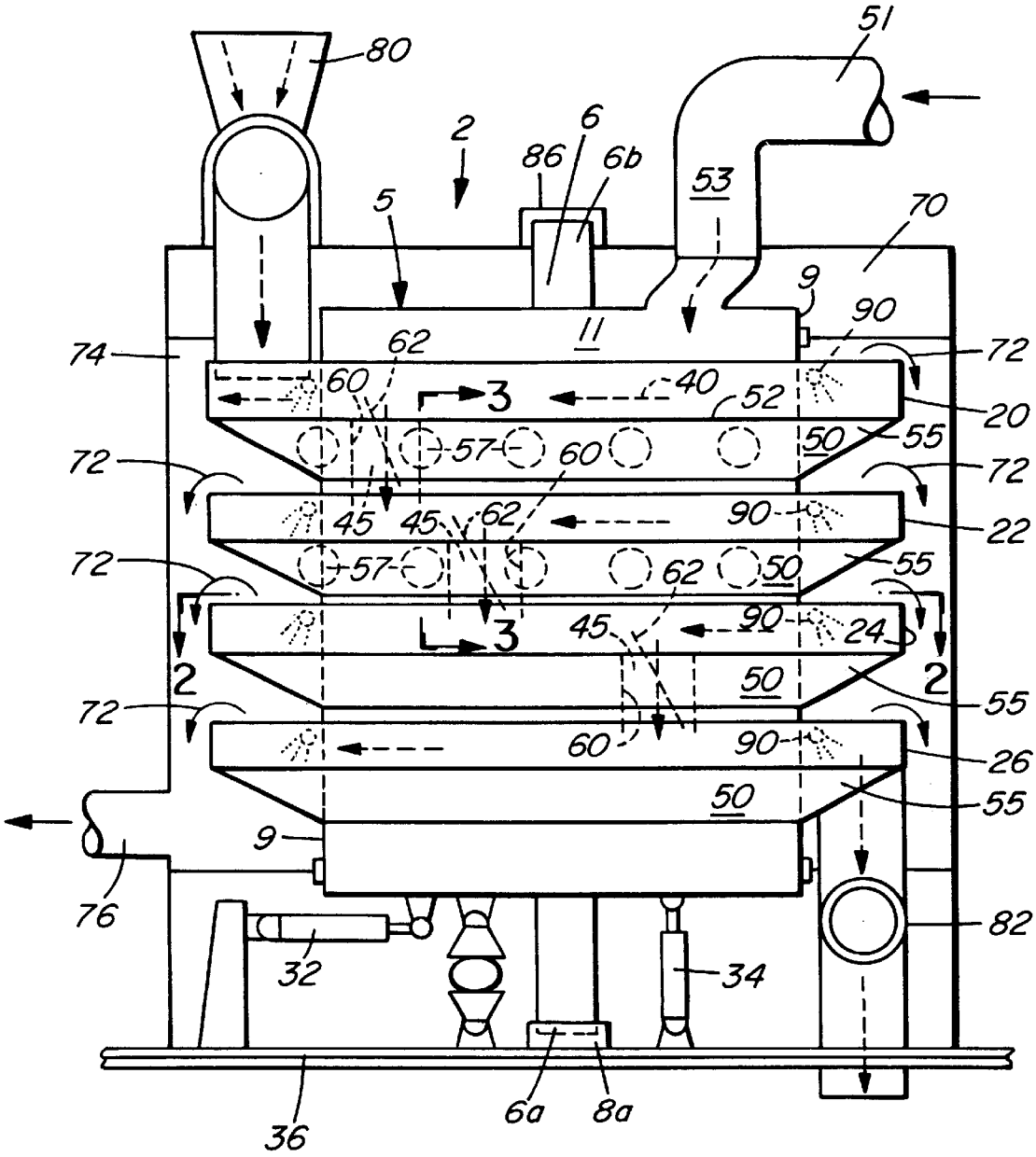
FIG. 1 is a schematic view of the conditioning apparatus of the present invention according to a preferred embodiment for drying particulate material.

Referring to FIG. 1, there is shown an elevation view of a conditioning apparatus 2 for handling particulate material according to a preferred embodiment of the present invention. The conditioning apparatus illustrated and described below in detail is intended primarily for simultaneously conveying and drying the particulate material thereon by passing a drying gas through the material. It will be apparent to those skilled in the art that the conditioning apparatus of the present invention can also be use to treat a gas as the gas passes through particulate material which acts as a filter.

Conditioning apparatus 2 include a central frame in the form of a cylindrical structure 5 defined by a cylindrical outer wall 9 enclosing a hollow interior 11. Axial posts 6 aligned with the longitudinal axis of cylindrical structure 5 extend from the ends of the structure to maintain the structure in a generally vertical orientation. The ends 6*a* and 6*b* of posts 6 are retained in cavities 8*a* and 8*b*, respectively, to maintain the cylindrical structure upright while permitting vibratory motion of the posts and the attached structure.

Figure 2:
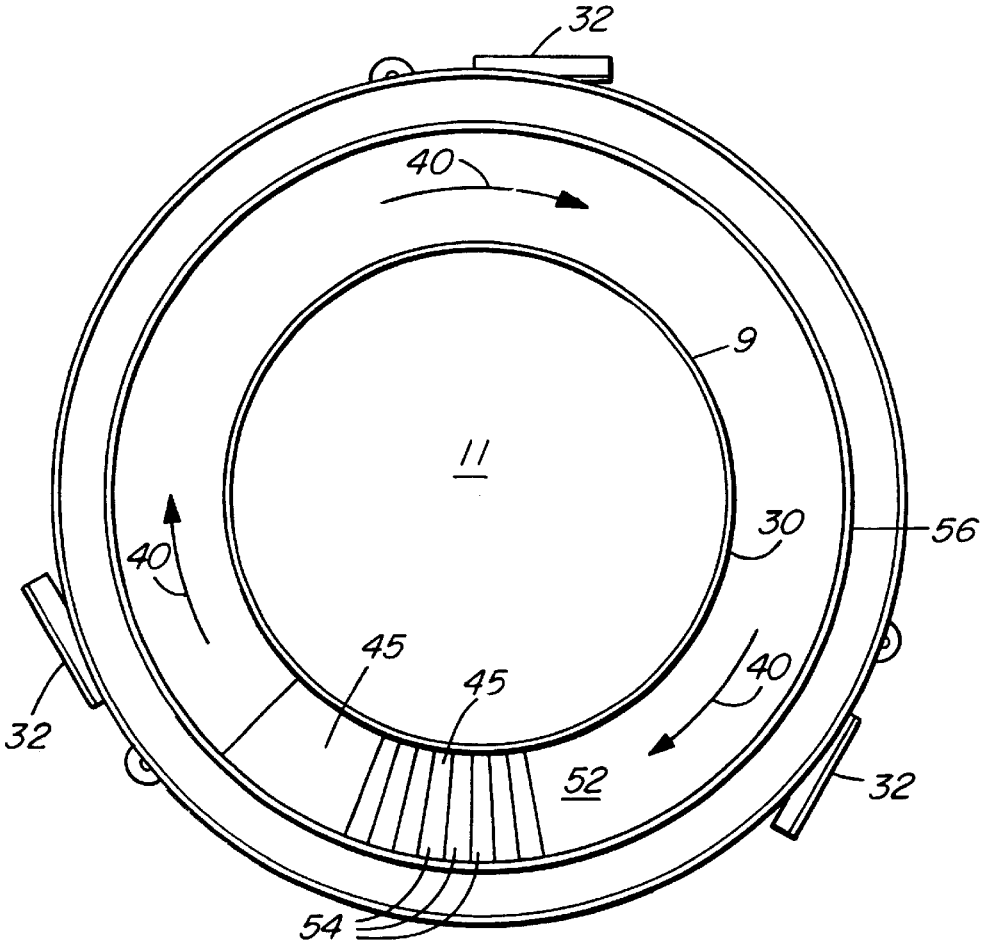
FIG. 2 is a section view taken along line 2—2 of FIG. 1.

There are a plurality of spaced, annular troughs 20,22,24 and 26 mounted to the central frame to support the particulate material. The troughs are arranged in a stacked, generally parallel configuration along the longitudinal axis of the cylindrical structure having successive pairs of upper and lower troughs with an uppermost trough 20 for receiving the particulate material and a lowermost trough 26 for discharging particulate material. While four stacked troughs are illustrated in FIG. 1, it will be apparent to a person skilled in the art that the number of troughs will be selected depending on the desired capacity of the conditioning apparatus. FIG. 2 is a section view taken along line 2—2 of FIG. 1 that shows a typical trough 24 in plan view mounted by an inner annular edge 30 to the perimeter of cylindrical outer wall 9 to encircle the wall.

Referring to FIG. 1, means for vibrating the plurality of troughs are provided in the form of hydraulic cylinders 32 and 34. The cylinders act to fluidize and advance the particulate material in the troughs in a first direction on each of the plurality of troughs. Cylinders 32 and 34 extend between the central frame and a massive base 36 on which the conditioning apparatus is mounted and are positioned to impart generally vertical (cylinders 34) and generally horizontal (cylinders 32) vibratory motion to the central cylindrical structure and the attached troughs. The cylinders are controlled in a known manner such that they co-operate to fluidize particulate material on the troughs and advance the material in the clockwise direction indicated by arrows 40 in FIGS. 1 and 2. Various hydraulic cylinder arrangements for imparting controlled vibratory motion to an object are disclosed in applicant's U.S. Pat. No. 5,816,386 the disclosure of which is incorporated herein by reference.

The conditioning apparatus of the present invention can be used with other means for imparting vibratory motion such as mechanical, electrical, or pneumatic devices. These include hinged rocker arms, eccentrically loaded wheels, pulsating magnets or pneumatic cylinders.

Figure 4:
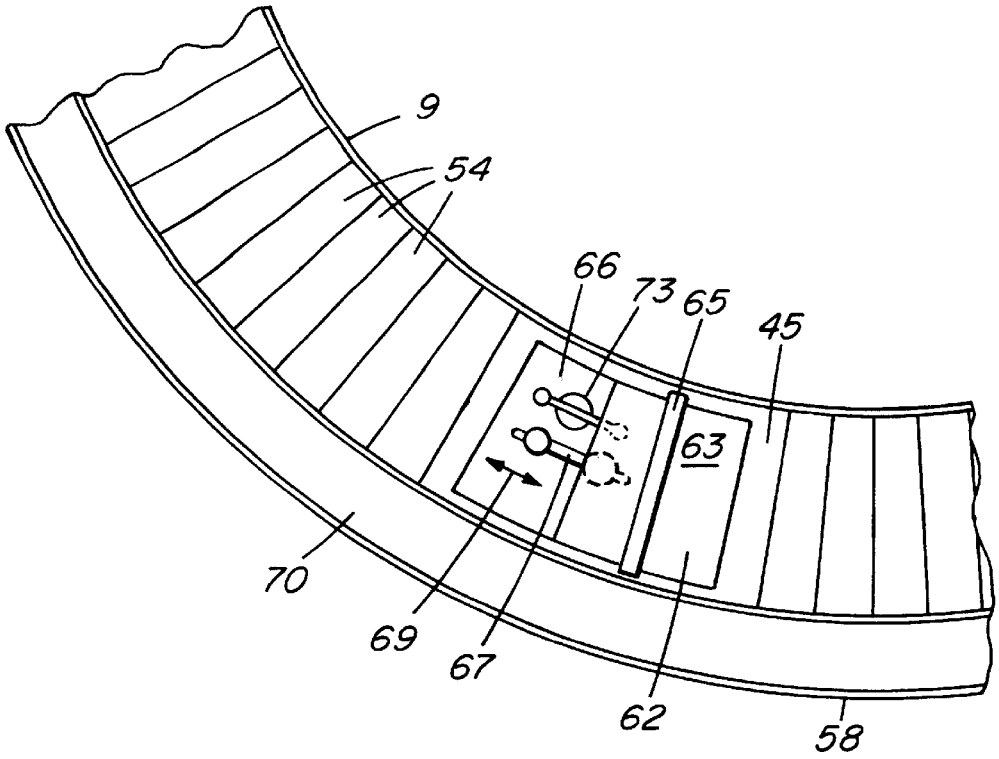
FIG. 4 is a detail plan view of a section of a trough.

In order for particulate material advancing on an upper trough of a pair to move to a lower trough, passages 45 are formed through each trough as best shown in FIGS. 1, 2 and 4. When fluidized particulate material advancing on a trough reaches passage 45, the material falls through and down to the next lower trough. In falling, the particulate material is free to tumble and rotate to ensure that larger pieces are re-oriented on the lower trough. An important feature of the apparatus is that the passage of an upper trough is non-aligned in a vertical plane with the passage of a lower trough. This ensures that particulate material falling from the upper trough is received on the lower trough to travel around the lower trough for one complete revolution before reaching the passage and falling to the next trough layer. In the illustrated example of FIG. 1, this is achieved by having the openings of successive lower troughs angularly offset with respect to the axis of cylindrical structure 5 in a counter-clockwise direction opposite to the clockwise direction of advancement of the particulate material. This ensures that particulate material does not fall through successive openings directly from the uppermost trough 20 to the lowermost trough 26. As material advances through the apparatus, fluidization by vibration on each trough level and tumbling during falling through passage 45 will tend to ensure that all particulate material including larger pieces have all possible surface area exposed at some time during transit through the apparatus for conditioning operations.

To promote the tumbling action of the particulate material, a mixing surface 62 extends into each passage 45 such that particulate material falling from an upper trough to a lower trough impinges against the surface. Particles striking surface 62 will tend to bounce, rotate and cascade down the surface 62 to improve mixing.

Figure 5:
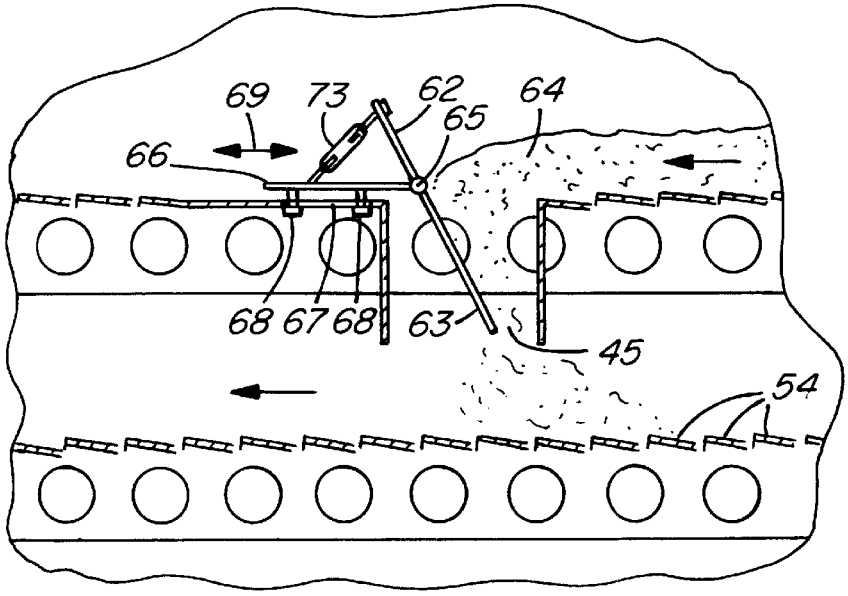
FIG. 5 is a detail elevation view of a portion of a trough showing the mixing surface extending into the passage between upper and lower troughs.

The apparatus of FIG. 1 functions both to dry particulate material using a drying gas or to filter a gas using particulate material. Gas conduits 50 are formed beneath the troughs to communicate the troughs with a source (not shown) of drying gas or a source of gas to be filtered (not shown). Each trough 20, 22, 24 and 26 is formed with a permeable floor 52 to permit passage of the gas from conduits 50 through the floor and through the fluidized particulate material supported on the trough floor. Floor 52 may be rendered permeable by using a plurality of overlapping tranverse slats 54 as best shown in FIGS. 2 and 5. A gas permeable trough floor of this type is described in applicant's U.S. Pat. No. 6,035,543, the disclosure of which is incorporated herein by reference. Other techniques for making trough floor 52 gas permeable are possible, such as forming a pattern of spaced openings that are smaller than the particulate material supported on the trough floor.

Figure 3:
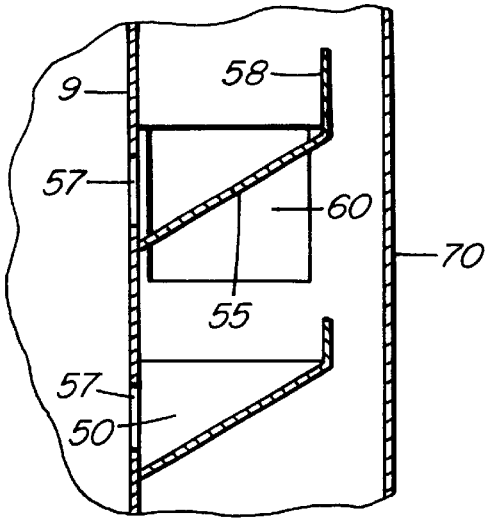
FIG. 3 is section view taken along line 3—3 of FIG. 1.

In order to deliver gas efficiently to gas conduits 50, it is preferable that the gas from the gas source be introduced into the interior 11 of cylindrical structure 5 via gas inlet 51 as indicated by arrows 53. Each of the plurality of troughs is mounted to outer wall 9 of the cylindrical structure 5 by an inner edge 30 as best shown in FIG. 3 which is cross-section through a pair of adjacent troughs taken along line 3—3 of FIG. 1. Each trough is formed with an upstanding wall 58 at an outer edge 56 to retain the particulate material on the floor of the trough between the upstanding wall and the outer wall 9 of cylindrical structure 5.

Preferably, a baffle 55 extends downwardly inwardly from outer edge 56 of each trough to outer wall 9 of cylindrical structure 5 to define the gas conduits 50 below the troughs which have a generally triangular cross-section. Openings 57 through outer wall 9 communicate the gas in the interior 11 of the cylindrical structure 5 with generally triangular conduits 50 below the troughs. The only path for gas introduced into interior 11 to escape is to travel through the permeable trough floor 52 and the fluidized particulate material thereon.

Passages 45 that extend through each trough include downwardly depending side walls 60 that seal the passages from the gas conduits 50 below the trough.

FIGS. 4 and 5 are detailed plan and elevation views, respectively, of a typical trough structure showing further details of the mixing surface 62. Preferably, mixing surface 62 comprises an angled plate 63 extending into passage 45 to provide a surface on which the falling particulate material 64 impinges. Particles striking the plate will tend to rotate and reorient for improved mixing. Plate 63 is pivotally mounted to a generally horizontal flange 66 via hinge joint 65. Flange 66 is mounted to the floor of the trough by at least two fasteners 68 with heads that extend through slot 67 in flange 66 to permit slidable adjustment of the flange in the direction of arrow 69 to a desired position. Fasteners 68 are tightened down to lock flange 66 in place. Plate 63 also includes locking means to releasably fix the angle to which the plate is pivoted. In the illustrated embodiment, the locking means comprises a turnbuckle 73 extending between flange 66 and plate 63. Lengthening or shortening of turnbuckle 73 acts to pivot plate 63 about joint 65 to vary the angle of the plate. Other locking means such as threaded fasteners or telescoping members extending between plate 63 and flange 66 can also be used.

Slidable movement of flange 66 permits adjustment of the lateral position of angle plate 63 within passage 45. At the same time, hinge joint 65 permits variation in the angle of the plate within passage 45. Varying the angle and position of the plate allows for adjustment of the mixing action by changing the surface area of the plate in the path of falling particulate material. The lateral position and angle of the plate can also be adjusted to suit the size of the particulate material.

In order to control and collect gas that passes through the fluidized particulate material on the troughs, an outer cover is 70 is provided to enclose and substantially seal the conditioning apparatus. As shown by arrows 72, gas exiting from the permeable troughs is collected in region 74 within cover 70. The cover 70 has an outlet 76 to draw off the collected gas.

When the conditioning apparatus of the present invention is operated to dry particulate material, the particulate material is delivered to uppermost trough 20 by a feeder 80. Vibratory movement of apparatus causes the particulate matter to make a full circuit about each trough and then descend through passage 45 to the next lower trough until the particulate material reaches discharge feeder 82. At each trough level, gas flows from conduit 50 through the fluidized material to dry the material. The vibration of the apparatus is controlled to determine the extent of fluidization of the particulate material, the advancement velocity and the retention time in the apparatus such that material reaching the discharge feeder is dried to a pre-determined level. Gas can be recirculated through outlet 76 and dehumidified after each cycle to provide a constant drying gas source.

When the conditioning apparatus of the present invention is operated to filter or scrub a gas, it is the particulate material that is recirculated between discharge feeder 82 and feeder 80. Gas to be treated is introduced through inlet 51 and travels through the fluidized particulate material in the troughs to be processed. In the case of scrubbing, the particulate material is wetted with an appropriate reagent to remove a pollutant gas. Wetting can be performed, for example, by a system of annular sprinkler pipes 90 that extend above each trough (FIG. 1). In the case of filtering, the particulate material acts as a physical filter to remove contaminant particles. Processed gas is collected at outlet 76. The particulate material is selected to be an inert material, wet or dry, that removes a contaminant from the gas. The particulate material is re-conditioned between discharge and infeed to remove the contaminant and to prepare the material for another filtering cycle.

Although the present invention has been described in some detail by way of example for purposes of clarity and understanding, it will be apparent that certain changes and modifications may be practised within the scope of the appended claims.

I claim:

1. Conditioning apparatus for handling particulate material comprising:

a central frame;

a plurality of spaced, annular troughs mounted to the central frame to support the particulate material, the troughs being arranged in a stacked configuration having successive pairs of upper and lower troughs with an uppermost trough for receiving the particulate material and a lowermost trough for discharging particulate material;

means for vibrating the plurality of troughs to fluidize and advance the particulate material in a first direction on each of the plurality of troughs;

a passage formed through each trough for particulate material to fall from the upper trough of a pair to the lower trough, the passage of the upper trough being non-aligned in a vertical plane with the passage of the lower trough such that particulate material falling from the upper trough is received on the lower trough to travel in the first direction over the distance of the lower trough before reaching the passage of the lower trough; and a mixing surface in each passage to promote tumbling of the particulate material when falling through the passage, the mixing surface comprising an angled plate extending into each passage to provide a surface on which the falling particulate material impinges, the mixing surface being pivotally mounted and including locking means to releasably fix the angle to which the surface is pivoted.

2. Conditioning apparatus as claimed in claim 1 in which the central frame is a generally cylindrical structure with a cylindrical outer wall and the troughs extend about the perimeter of the outer wall.

3. Conditioning apparatus as claimed in claim 2 including gas conduits communicating the troughs with a gas source, each trough having a permeable floor to permit passage of the gas through the floor.

4. Conditioning apparatus as claimed in claim 3 in which the cylindrical structure has a hollow interior to receive gas from the gas source, and each of the plurality of troughs is mounted to the outer wall by an inner edge with a baffle extending downwardly from the trough to the cylindrical outer wall to define the gas conduit below the trough, the gas conduit receiving gas from the interior via openings formed in the cylindrical outer wall.

5. Conditioning apparatus as claimed in claim 4 in which each of the plurality of troughs is formed with an upstanding wall at an outer edge to retain the particulate material on the floor of the trough between the upstanding wall and the outer wall of the cylindrical structure.

6. Conditioning apparatus as claimed in claim 4 in which each passage formed through the troughs includes downwardly depending walls that seal the passage from the gas conduit below the trough.

7. Conditioning apparatus as claimed in claim 4 including an outer cover to surround and substantially seal the apparatus to collect gas exiting from the permeable troughs, the outer cover having an outlet for circulation of the collected gas.

8. Conditioning apparatus as claimed in claim 1 in which the means for vibrating the plurality of troughs comprises a plurality of hydraulic cylinders extending between the central frame and a base and positioned to impart generally vertical and generally horizontal vibratory motion to the central frame.

9. Conditioning apparatus as claimed in claim 1 including recirculating means for receiving discharged particulate material from the lowermost trough and delivering the material to the uppermost trough.

10. Conditioning apparatus as claimed in claim 1 including a sprinkler system for delivering a wetting agent to particulate material in the troughs.

11. Conditioning apparatus as claimed in claim 1 in which the plate is adjustably mounted to permit variation in the position of the plate within the passage.

* * * * *